US005627350A

United States Patent [19]

Kang

[11] Patent Number: 5,627,350

[45] Date of Patent: May 6, 1997

[54] SPEAKER HOUSING COMBINATION

[76] Inventor: Shih-Chang Kang, No. 33, Hsia-Hsi, Hsia-Hsi Li, Hu-Wei Chen, Yun-Lin County, Taiwan

[21] Appl. No.: 568,786

[22] Filed: Dec. 7, 1995

[51] Int. Cl.[6] ..... A47B 81/06

[52] U.S. Cl. ..... 181/199

[58] Field of Search ..... 181/199, 148; 381/88, 159, 205; 312/7.1, 7.2

[56] References Cited

U.S. PATENT DOCUMENTS

| | | | |
|---|---|---|---|
| 4,284,168 | 8/1981 | Gaus | 181/199 |
| 4,451,711 | 5/1984 | Jackson | 312/7.1 X |
| 4,773,502 | 9/1988 | Adair | 181/199 X |
| 5,056,618 | 10/1991 | Jordan | 181/199 |

*Primary Examiner*—Khanh Dang
*Attorney, Agent, or Firm*—Charles E. Baxley, Esq.

[57] ABSTRACT

A speaker housing combination includes two side plates each having two strips extended from the upper and the lower portions so-as to form two channels and each having two shoulders formed in the front and the rear portions. A top and a bottom plate each has two flanges extended from the side portions for engaging with the channels and each has a shoulder formed in the front and the rear portion. A front and a rear plates each has the edges engaged with the shoulders so as to be solidly secured to the top and the bottom plates and the side plates. The top and the bottom plates may further be secured together by fastening members. The plates may be easily assembled by the users and may be stored in a compact volume which is excellent for storing and for transportation purposes.

2 Claims, 7 Drawing Sheets

SPEAKER HOUSING COMBINATION

BACKGROUND OF THE INVENTION

1. Field of the Invention

The present invention relates to a housing, and more particularly to a speaker housing combination.

2. Description of the Prior Art

Typical speaker housings are made of wood materials and comprise a number of plates that are solidly secured together so as to form a parallelepiped body which occupies a large volume that; is adverse for storing and for transportation purposes. In addition, a number of woods are required (to be cut in order to provide the wood materials for making the speaker housings.

The present invention has arisen to mitigate and/or obviate the afore-described disadvantages of the conventional speaker housings.

SUMMARY OF THE INVENTION

The primary objective of the present invention is to provide a speaker housing combination which includes a number of plates that may be easily assembled by the users and that may be stored in a compact volume.

In accordance with one aspect of the invention, there is provided a speaker housing combination comprising two side plates each including an upper portion and a lower portion each having a strip extended therefrom so as to define a channel in the upper and the lower portions respectively, and each including a front portion and a rear portion each having a first shoulder formed therein, a top plate and a bottom plate each including two side portions each having a flange extended therefrom for engaging with the channels of the side plates, and each including a front portion and a rear portion each having a second shoulder formed therein; a front plate including an upper and a lower portion engaged with the second shoulders of the top plate and the bottom plate respectively and including two side portions engaged with the first shoulders of the side plates; and a rear plate including an upper and a lower portion engaged with the second shoulders of the top plate and the bottom plate respectively and including two side portions engaged with the first shoulders of the side plates.

The strips each includes at least one notch formed therein and each includes at least one rib formed thereon, the top plate and the bottom plate each includes at least one projection extended therefrom for engaging with the notches of the side; plates and each includes at least one depression formed therein for engaging with the ribs so as to solidly secure the top plate and the bottom plate to the side plates.

A plurality of fastening members are engaged with the strips and engaged with the projections so as to secure the strips to the top plate and the bottom plate.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
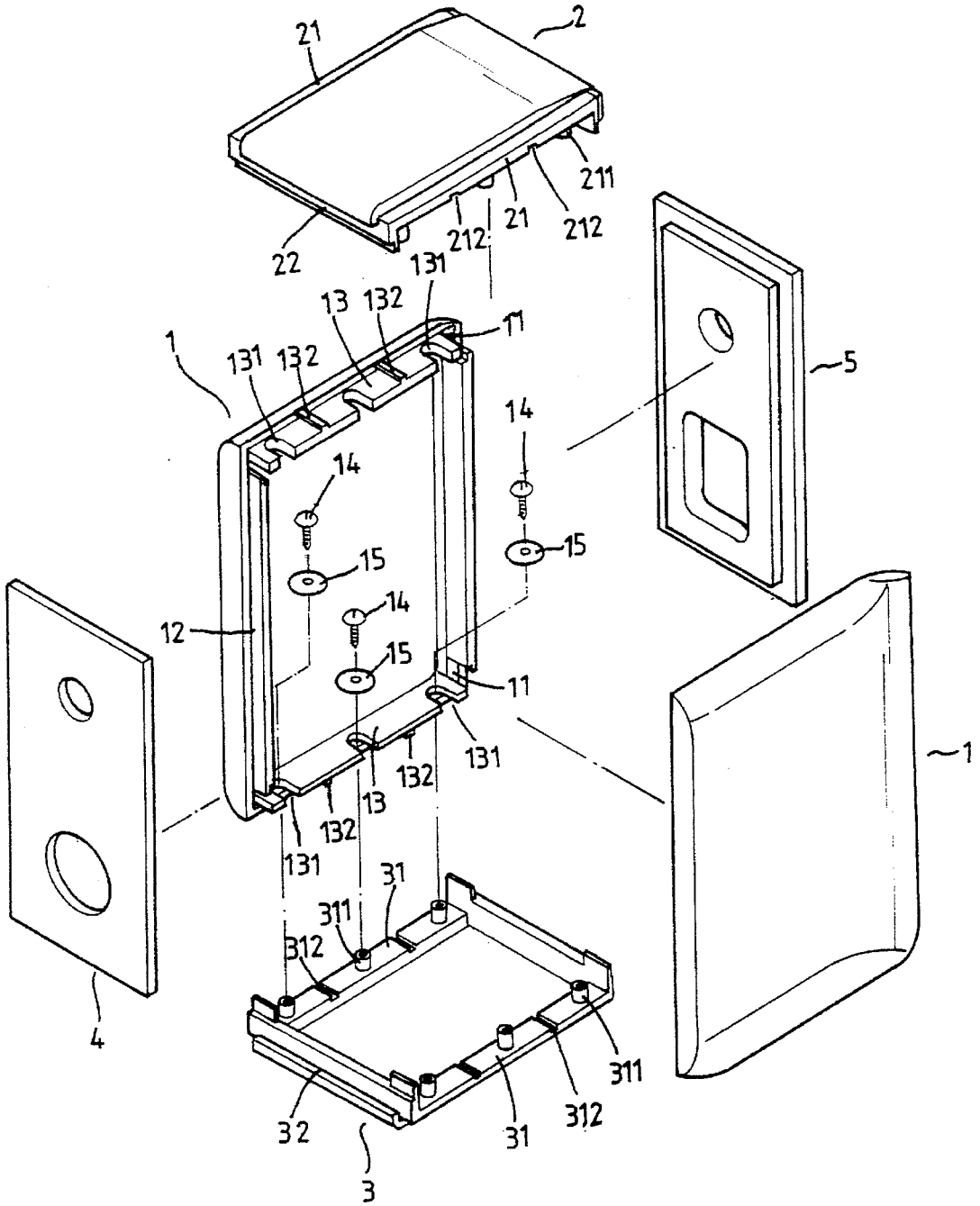
FIG. 1 is an exploded view of a speaker housing combination in accordance with the present invention.
Figure 2:
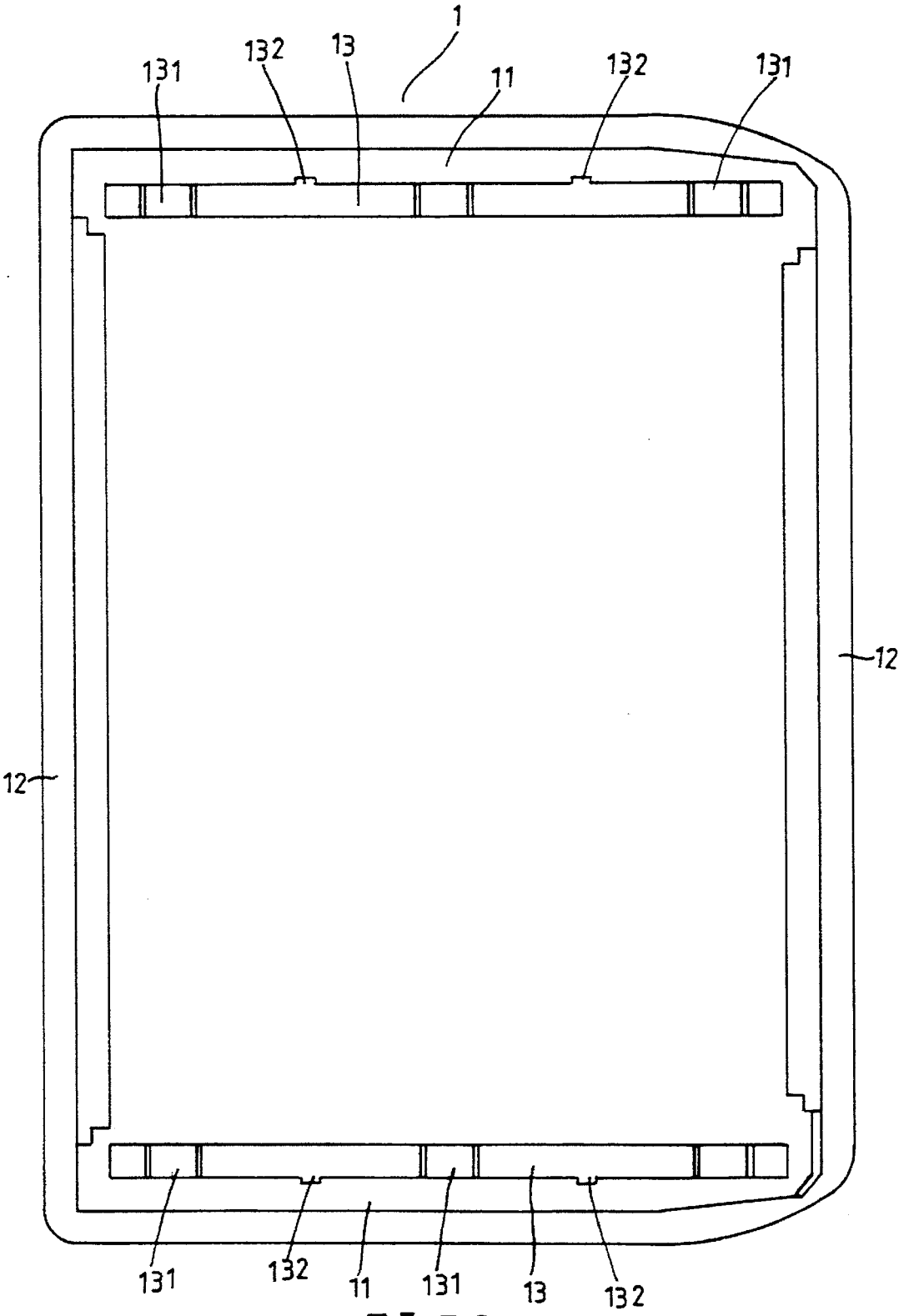
FIG. 2 is a plane view of a side plate.
Figure 3:
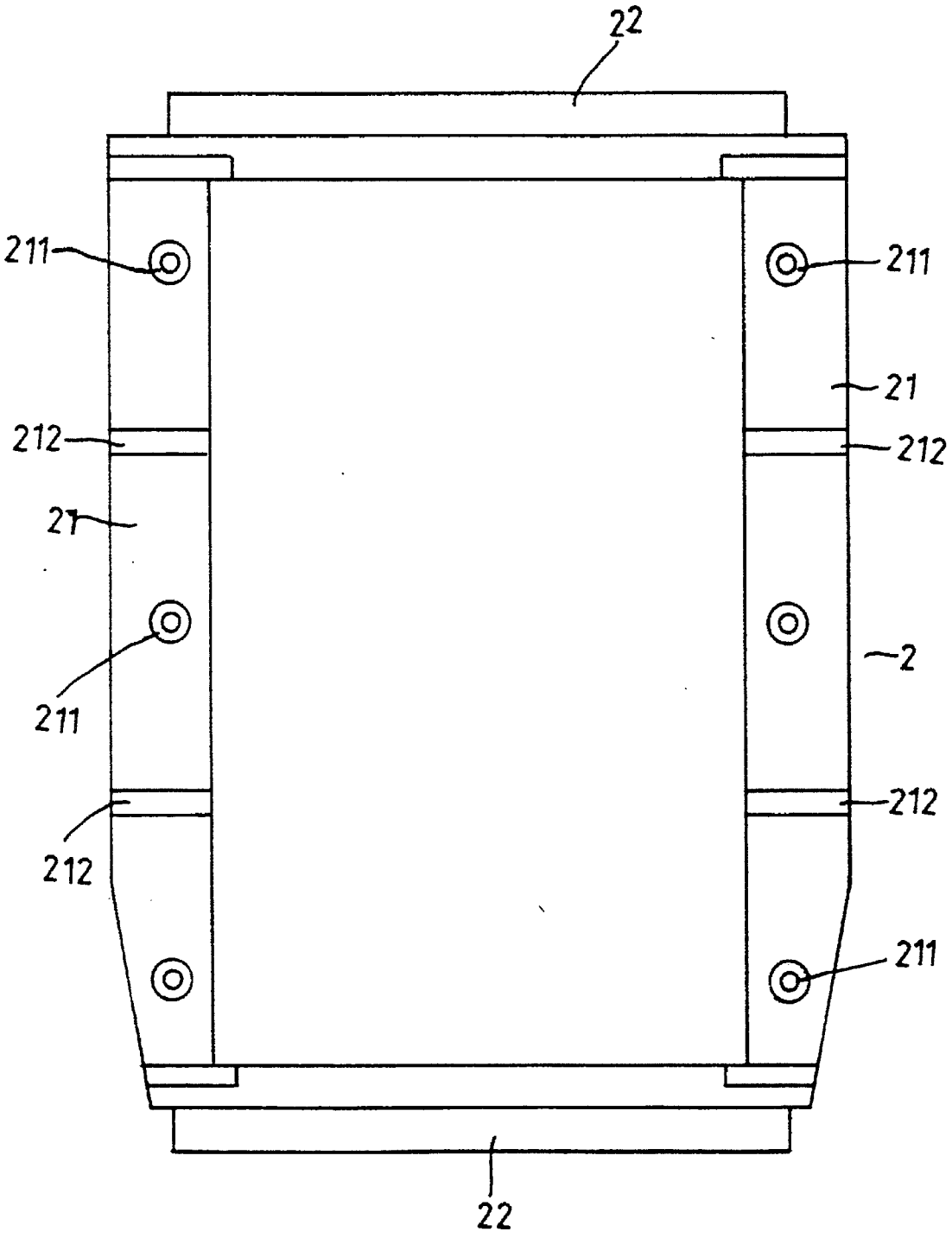
FIG. 3 is a plane view of a top plate and a bottom plate.

Referring to FIGS. 1 to 5 a speaker housing combination in accordance with the present invention comprises two side plates 1, a top plate 2, a bottom plate 3, a front plate 4 and a rear plate 5. The plates are preferably made of fiber reinforced plastic materials (abbreviated as FRP hereinafter) which is a thermosetting plastic material and which may endure a temperature of up to 200° C. The plates of FRP materials include a great strength and are fire and temperature resistive. In addition the plates may be easily applied a painting layer or a coating onto the outer peripheral portion thereof and may be easily applied various kinds of colors thereon. The specific weight of the plates is up to 1.8 to 2.0. The front plate 4 and the rear plate 5 may be made by wood materials.

The side plates 1 each includes a pair of strips 13 extended from the upper and the lower portions respectively so as to define a pair of channels 11 in the upper and the lower portions respectively. The side plates 1 each includes a front and a rear shoulders 12. The strips 13 each includes a number of notches 131 formed therein and each includes one or more ribs 132 formed thereon. The top plate 2 includes two side flanges 21 for engaging with the channels 11 of the side plates 1 and includes a front and a rear shoulders 22 formed therein. The top plate 2 includes a number of projections 211 extended therefrom for engaging with the notches 131 of the side plates 1 and includes a number of depressions 212 formed therein for engaging with the ribs 132 so as to solidly secure the top plate 2 to the side plates 1. The bottom plate 3 includes a structure identical to that of the top plate 2 and having two side flanges 31 for engaging with the channels 11 of the side plates 1 and having a front and a rear shoulders 32 formed therein. The bottom plate 3 includes a number of projections 311 extended therefrom for engaging with the notches 131 of the side plates 1 and includes a number of depressions 312 formed therein for engaging with the ribs 132 so as to solidly secure the bottom plate 2 to the side plates 1. The bottom plate 3 and the top plate 1 may be formed by an identical mold piece. A number of screws 14 may be engaged through the washers 15 and may be engaged with the, projections 211, 311 so as to solidly secure the top plate 2 and the bottom plate 3 and the side plates 1 together.

The front plate 4 includes two side edges engaged in the front shoulders 12 of the side plates 1 and includes an upper and a lower edge engaged with the front shoulders 22, 32 of the top plate 2 and of the bottom plate 3 respectively such that the front plate 4 may be secured in place. It is preferably that the front plate 4 is further secured to the side plates and the bottom and the top plates 3, 2 by adhesive materials. The rear plate 5 includes a structure identical to that of the front plate 4 and includes two side edges engaged in the front shoulders 12 of the side plates 1 and includes an upper and a lower edge engaged with the rear shoulders 22, 32 of the top plate 2 and of the bottom plate 3 respectively such that the rear plate 5 may be secured in place. It is preferably that the rear plate 5 is further secured to the side plates and the bottom and the top plates 3, 2 by adhesive materials.

It is to be noted that the side plates 1 include an identical structure, and the top plate 2 and the bottom plate 3 also include an identical structure, such that the side plates 1 maybe manufactured by one mold piece and the top plate 2 and the bottom plate 3 may also be manufactured by another mold piece. The side plates 1, the top plate 2 and the bottom plate 3 may first be assembled and the electric elements can be disposed within the speaker housing combination before the front plate 4 and the rear plate 5 are secured in place. The plates 1, 2, 3, 4, 5 may be easily assembled and may be disassembled from each other such that the plates can be stored in a compact configuration that is excellent for storing and for transportation purposes.

Figure 4:
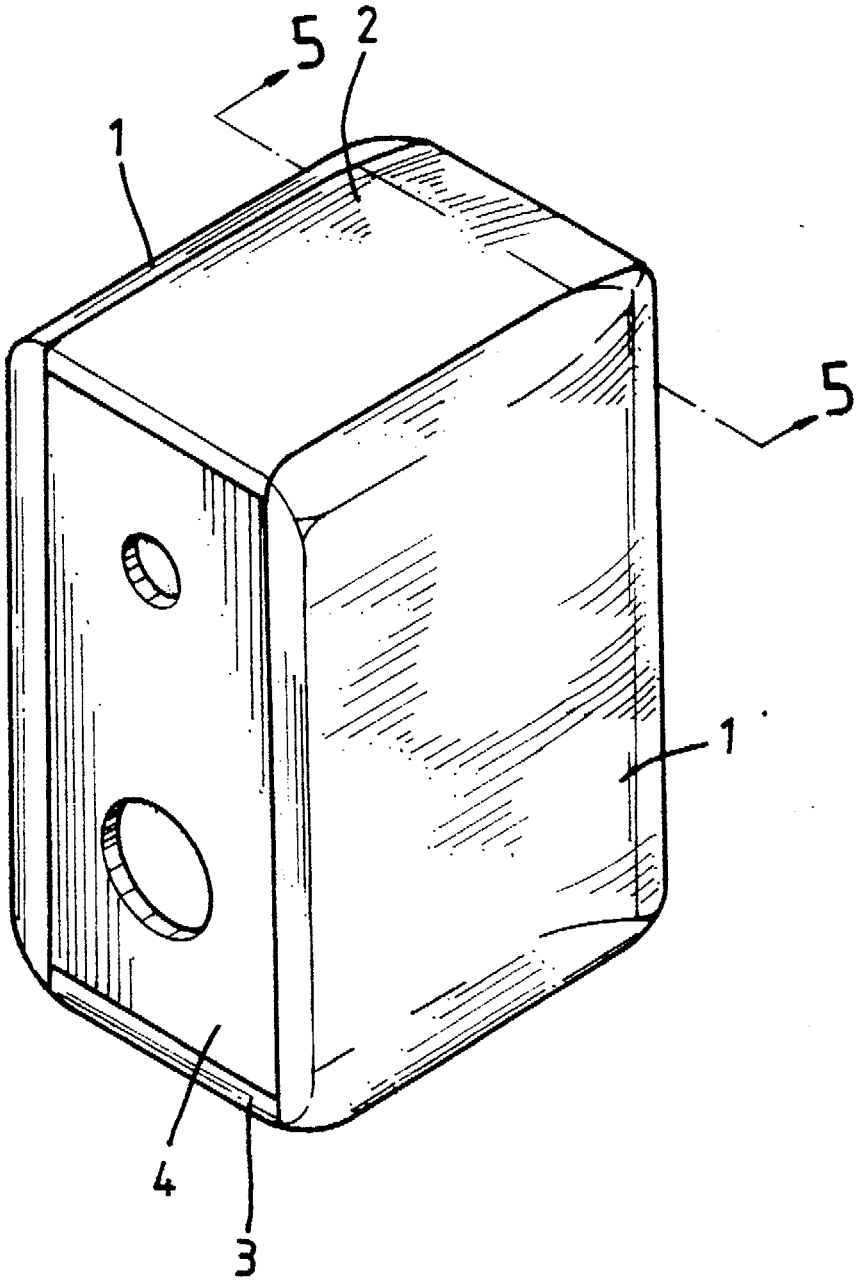
FIG. 4 is a perspective view of the speaker housing combination.
Figure 5:
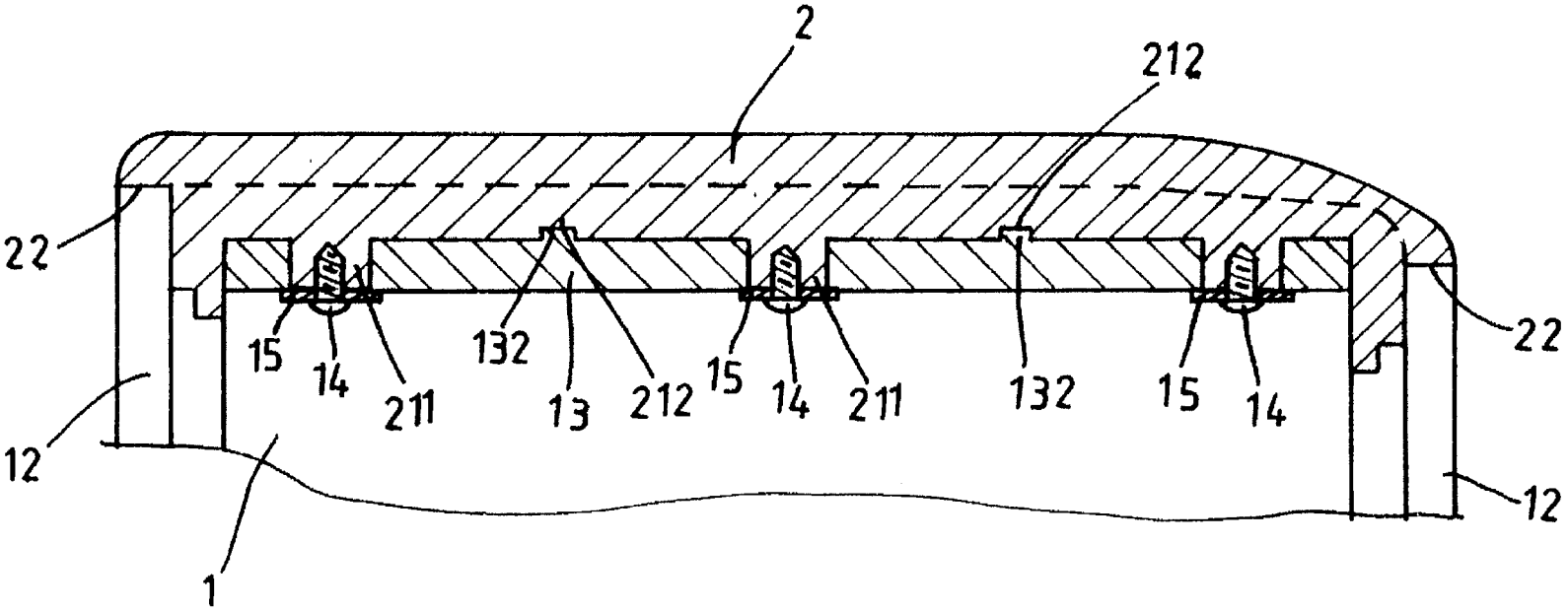
FIG. 5 is a cross sectional view taken along lines 5—5 of FIG. 4.
Figure 6:
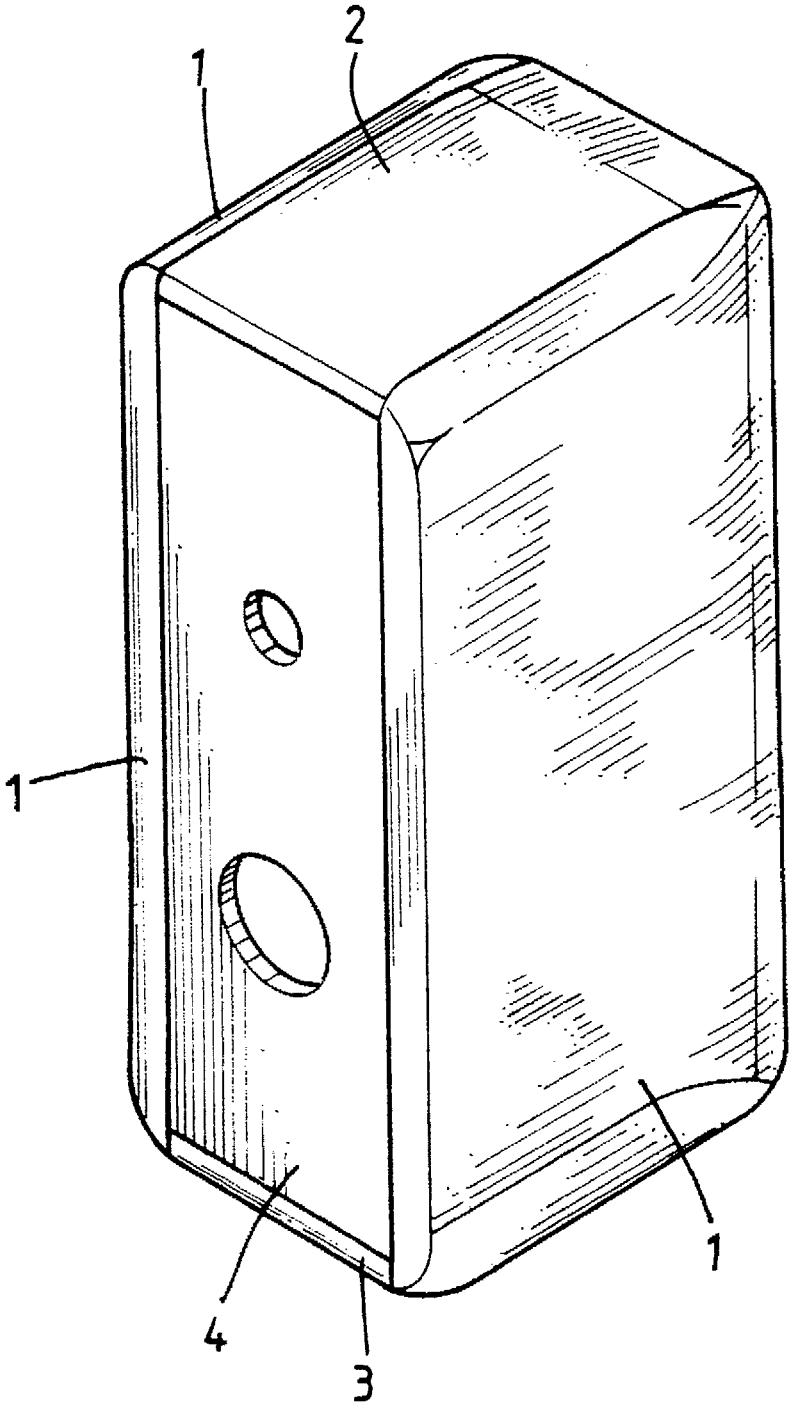
FIGS. 6 and 7 are perspective views showing two different shapes of the speaker housing combination.
Figure 7:
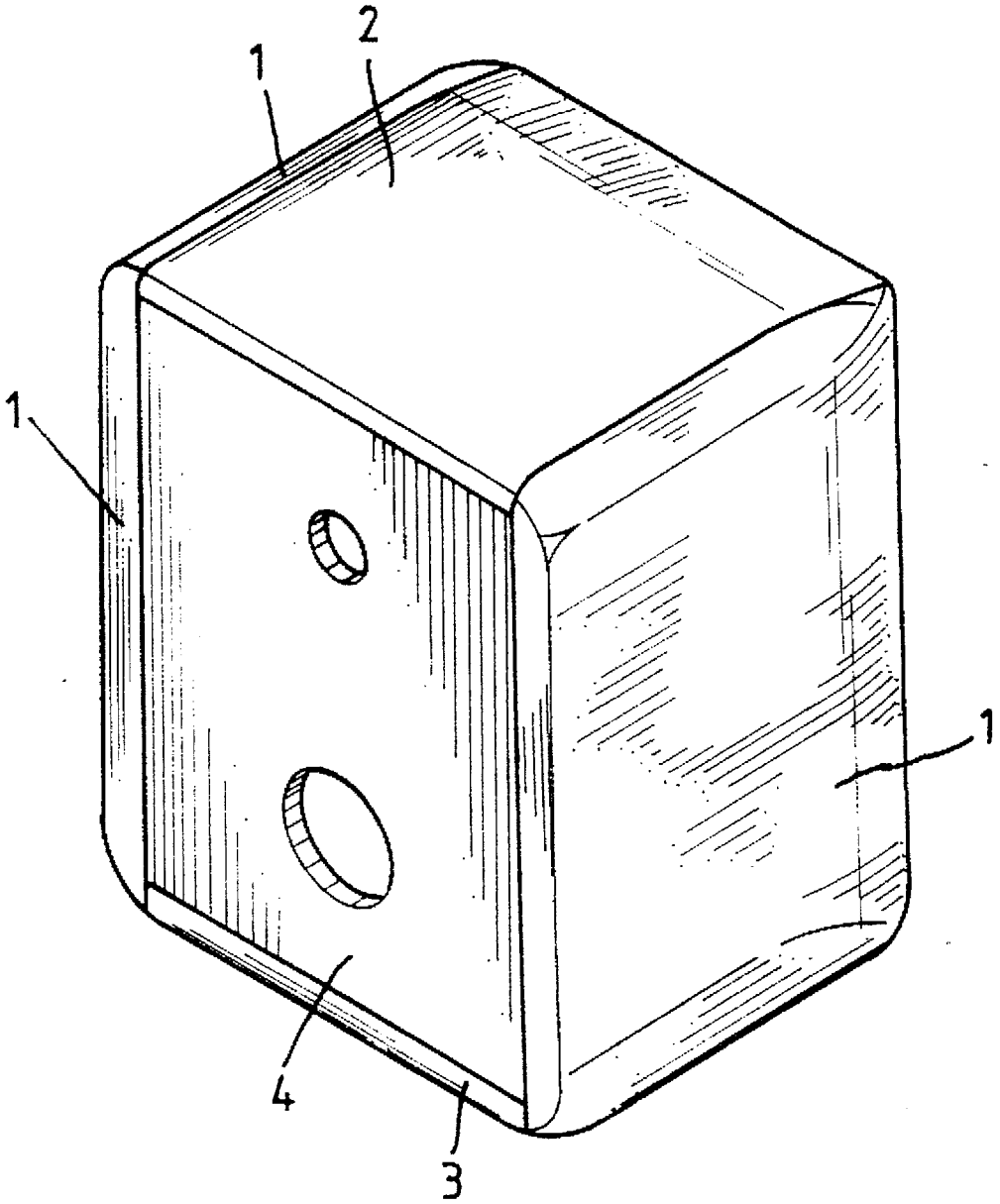

As shown in FIGS. 6 and 7, the speaker housing combination may be manufactured to different sizes as shown in FIGS. 6, 7 and 4.

Accordingly, the speaker housing combination in accordance with the present invention includes a number of plates that may be easily assembled by the users and that may be stored in a compact volume.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A speaker housing combination comprising:

two side plates each including an upper portion and a lower portion each having a strip extending therefrom so as to define a channel in said upper and said lower portions respectively, and each including a front portion and a rear portion each having a first shoulder formed therein, said strips each including at least one notch formed therein and each including at least one rib formed thereon, a top plate and a bottom plate each including two side portions each having a flange extended therefrom for engaging with said channels of said side plates, and each including a front portion and a rear portion each having a second shoulder formed therein, said top plate and said bottom plate each including at least one projection extended therefrom for engaging with said notches of said side plates and each including at least one depression formed therein for engaging with said ribs so as to solidly secure said top plate and said bottom plate to said side plates, a front plate including an upper and a lower portion engaged with said second shoulders of said top plate and said bottom plate respectively and including two side portions engaged with said first shoulders of said side plates; and a rear plate including an upper and a lower portion engaged with said second shoulders of said top plate and said bottom plate respectively and including two side portions engaged with said first shoulders of said side plates.

2. A speaker housing combination according to claim 1, further comprising a plurality of fastening members engaged with said strips and engaged with said projections so as to secure said strips to said top plate and said bottom plate.

* * * * *